US007156005B2

(12) United States Patent
Cluthe

(10) Patent No.: US 7,156,005 B2
(45) Date of Patent: Jan. 2, 2007

(54) MULTIPLE BIT HAND TOOL WITH AUTOMATIC BIT LOCKING

(75) Inventor: Gary Paul Cluthe, Waterloo (CA)

(73) Assignee: Duron Plastics Limited, Waterloo (CA)

( * ) Notice: Subject to any disclaimer, the term of this patent is extended or adjusted under 35 U.S.C. 154(b) by 0 days.

(21) Appl. No.: 10/926,965

(22) Filed: Aug. 27, 2004

(65) Prior Publication Data

US 2005/0045002 A1 Mar. 3, 2005

Related U.S. Application Data

(60) Provisional application No. 60/498,593, filed on Aug. 29, 2003.

(51) Int. Cl.
*B25G 1/08* (2006.01)

(52) U.S. Cl. ..... 81/490; 81/439

(58) Field of Classification Search ..... 81/177.85, 81/177.2, 438, 442, 443, 453, 455, 439
See application file for complete search history.

(56) References Cited

U.S. PATENT DOCUMENTS

| | | | | |
|---|---|---|---|---|
| 1,910,275 | A | 5/1933 | Alden | |
| 2,629,423 | A | 2/1953 | Stettler | |
| 2,635,661 | A | 4/1953 | Egan | |
| 3,006,395 | A | 10/1961 | Dye | |
| 3,750,729 | A | 8/1973 | Lemieux | |
| 4,692,073 | A * | 9/1987 | Martindell | 408/239 A |
| 4,716,795 | A | 1/1988 | Corona et al. | |
| 4,762,036 | A | 8/1988 | Orlitzkey et al. | |
| 4,768,405 | A | 9/1988 | Nickipuck | |

(Continued)

FOREIGN PATENT DOCUMENTS

| | | |
|---|---|---|
| DE | 297 08 384 | 8/1997 |

(Continued)

*Primary Examiner*—Joseph J. Hail, III
*Assistant Examiner*—Robert Scruggs
(74) *Attorney, Agent, or Firm*—R. Craig Armstrong; Borden Ladner Gervais LLP

(57) ABSTRACT

The hand tool has a chuck with a central axial opening through which bits or other tool elements are selectively moved from a retracted position to an extended operative position. A mechanical element automatically engages the tool element, such that as the tool element reaches its operative position, it is automatically locked in place, such that it cannot be retracted without user intervention to retract the mechanical element and thereby permit retraction of the tool element. In a specific preferred embodiment the mechanical element is at least one pivotally mounted cam, biased to engage the tool element once the tool element is extended to its operative position. A user-operable mechanism such as a collar for example, spring-biased against retraction, is arranged to contact the cam when retracted against the force of the spring, to rotate the cam so that it no longer engages the tool element, thus allowing the tool element to be retracted to its storage position.

17 Claims, 8 Drawing Sheets

U.S. PATENT DOCUMENTS

| | | | | |
|---|---|---|---|---|
| 4,953,640 | A | 9/1990 | Kurt | |
| 5,013,194 | A * | 5/1991 | Wienhold | 408/240 |
| 5,325,745 | A | 7/1994 | Koehler | |
| 5,337,637 | A * | 8/1994 | Bih-Lien | 81/439 |
| 5,526,721 | A * | 6/1996 | Waisvisz | 81/440 |
| 5,673,600 | A | 10/1997 | Yanagi et al. | |
| 5,791,212 | A * | 8/1998 | Han | 81/453 |
| 5,813,296 | A | 9/1998 | Hoff et al. | |
| 5,934,384 | A * | 8/1999 | Wang | 173/132 |
| 6,053,675 | A * | 4/2000 | Holland et al. | 408/239 R |
| 6,205,893 | B1 | 3/2001 | Sato | |
| 6,332,384 | B1 | 12/2001 | Cluthe | |
| 6,394,715 | B1 | 5/2002 | Boyle et al. | |
| 6,533,291 | B1 * | 3/2003 | Huggins et al. | 279/29 |

FOREIGN PATENT DOCUMENTS

| | | |
|---|---|---|
| DE | 298 20 263 | 1/1999 |

* cited by examiner

MULTIPLE BIT HAND TOOL WITH AUTOMATIC BIT LOCKING

REFERENCE TO RELATED APPLICATION

This is a formal application based on and claiming the benefit of U.S. provisional patent application No. 60/498,593, filed Aug. 29, 2003.

BACKGROUND OF THE INVENTION

1. Field of the Invention

The invention relates to a hand tool having multiple bits or other tool elements selectable for use one at the time. The bits or tool elements are movable between a retracted storage position within the handle of the tool, and an extended operative position.

The hand tool is normally a screwdriver. However, while the words "screwdriver" and "bits" are used for convenience throughout this description, it should be understood that these words are intended to be interpreted liberally, and thus could include hand tools with such tool elements as pen/pencil or scribing tips, or other non-screwdriver bits.

The invention is particularly directed towards a mechanism for automatically locking the tool elements in their operative position, when extended to that position.

2. Description of the Prior Art

In the past, different approaches have been tried to provide a hand tool or screwdriver having a plurality of bits accessibly stored in the handle of the screwdriver. Examples include U.S. Pat. No. 3,750,729 (Lemieux), U.S. Pat. No. 5,325,745 (Koehler), Canadian patent no.2,353,911 (Beauchamp), and U.S. Pat. No. 6,332,384 (Cluthe). The latter reference is by the present inventor.

However, to date there have been no satisfactory means for automatically locking the bits in their operative position, once extended to that position.

SUMMARY OF THE INVENTION

It is an object of the invention to provide a hand tool or screwdriver of the general type referred to above, but having a suitable means for automatically locking the bits or tool elements in their operative position, once extended to that position.

In the invention, the hand tool has a chuck with a central axial opening through which bits or other tool elements are selectively moved from a retracted position to an extended operative position. A locking means is provided, such that as the tool element reaches its operative position, the locking means automatically engages it, such that it cannot be retracted without user intervention.

In the preferred embodiment, a mechanical element is biased towards a notch, lip or other engagement means on the tool element, for example on a bit or bit holder, so that once the mechanical element is in the engagement means, the tool element cannot be retracted. A means for retracting the mechanical element is provided, so that the user can retract the mechanical element to permit the tool element to be retracted.

In a specific preferred embodiment there is at least one cam pivotally mounted in the chuck, biased so that it engages the tool element once the tool element is extended to its operative position. User-operable means such as a collar around the base portion, for example, biased by the spring against retraction, is arranged to contact the cam when retracted against the force of the spring, to rotate the cam so that it no longer engages the tool element, thus allowing the tool element to be retracted to its storage position.

In a particular embodiment, the hand tool is of the type orsimilarto the type described in the inventor's prior U.S. Pat. No. 6,332,384, as referred to above. However, it should be understood that the invention is applicable to any multi-bit tool of the general type described, regardless of the mechanism used to advance and retract the bits or other tool elements through the central axial opening of the chuck.

Further features will be described orwill become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE INVENTION

Figure 1:
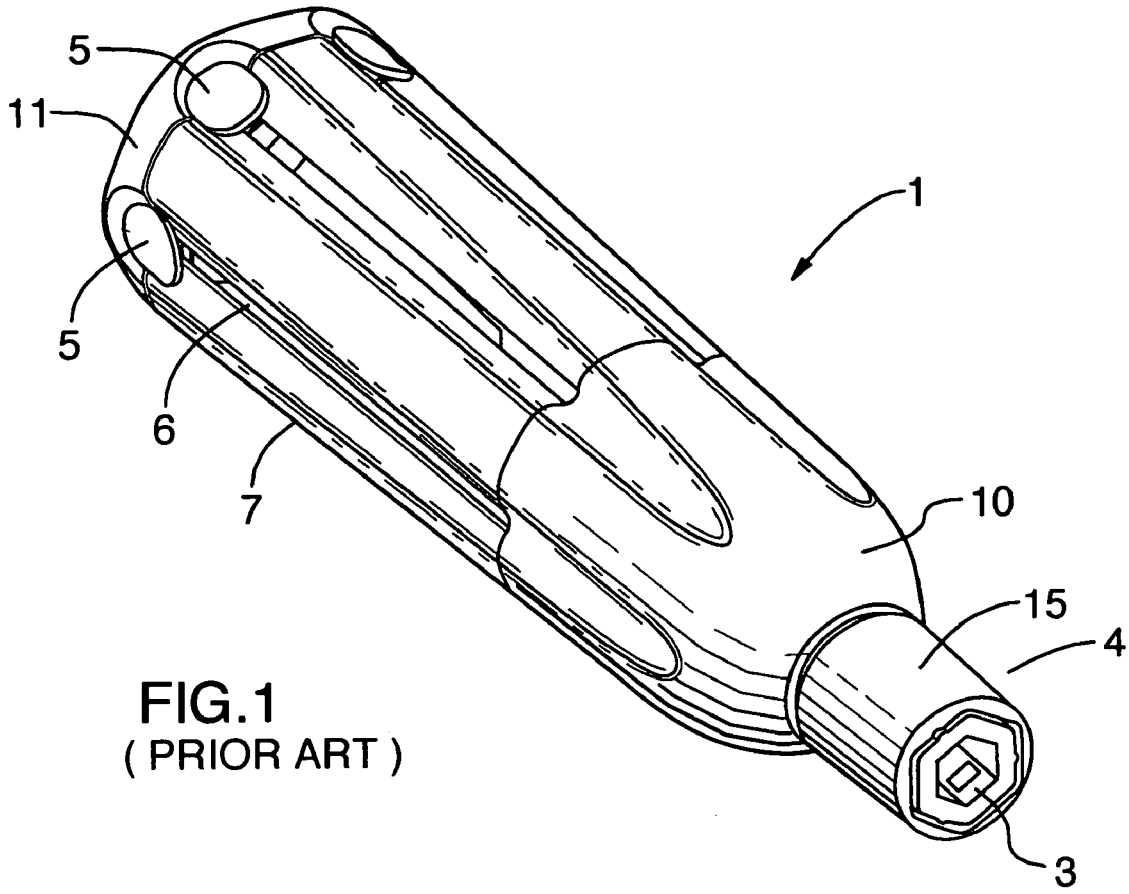
FIG.1 ( PRIOR ART )
FIG. 1 (prior art) is a perspective view of the inventor's prior art multiple bit hand tool of U.S. Pat. No. 6,332,384, showing all bits in their retracted positions.
Figure 2:
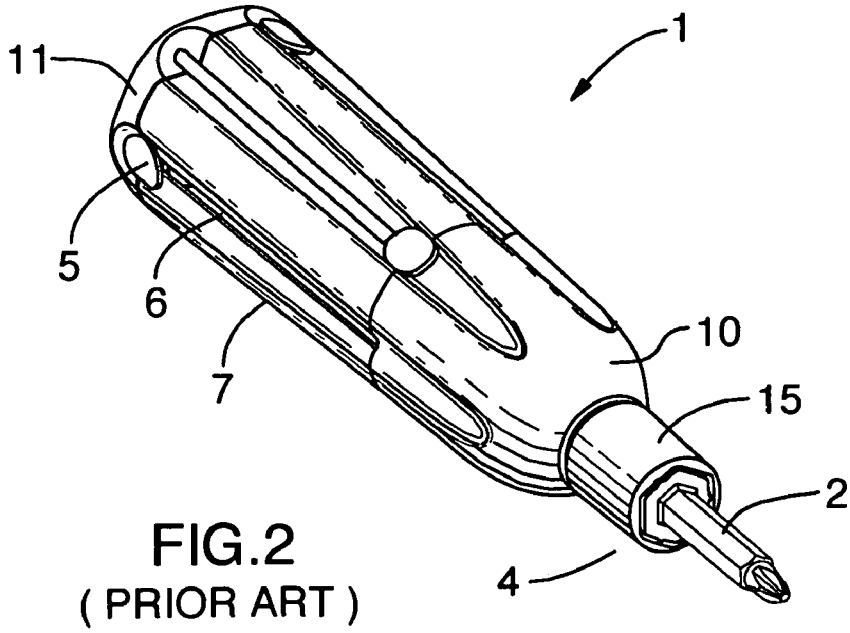
FIG.2 ( PRIOR ART )
FIG. 2 (prior art) is a perspective view of the hand tool of FIG. 1A, showing one bit in its extended position.
Figure 3:
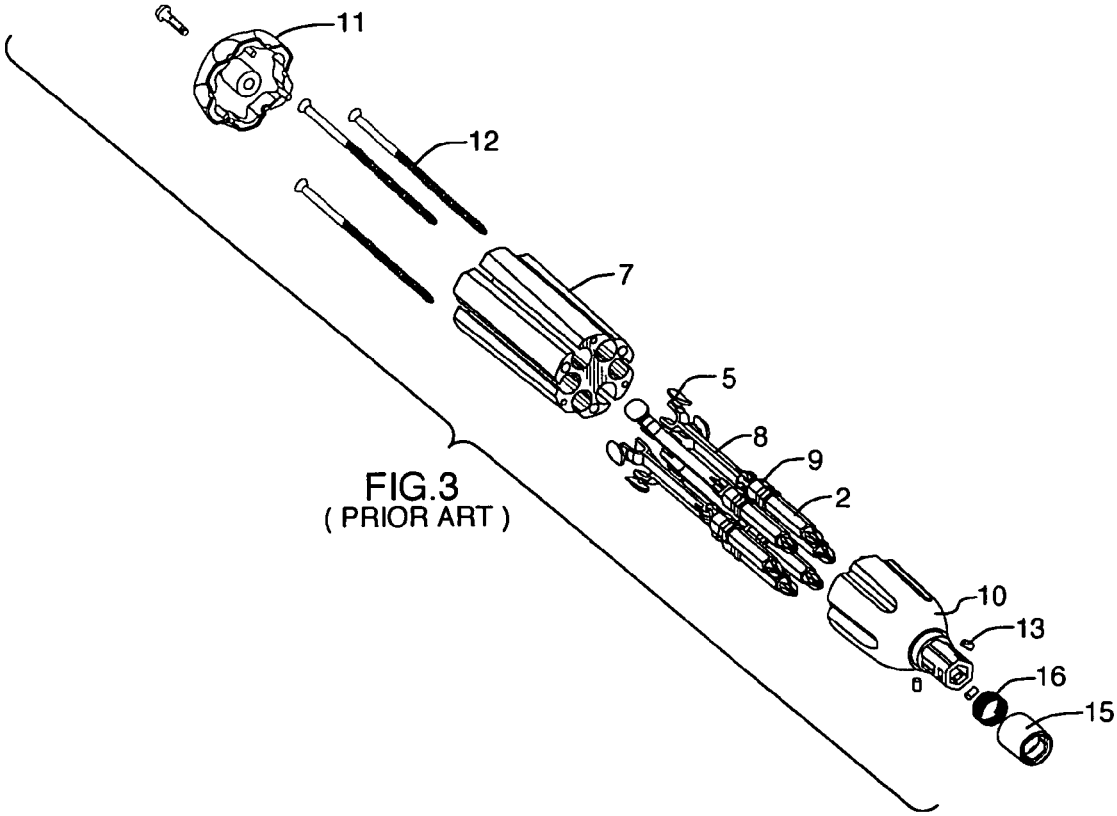
FIG.3 ( PRIOR ART )
FIG. 3 (prior art) is an exploded perspective view of the hand tool of FIG. 1A.
Figure 4:
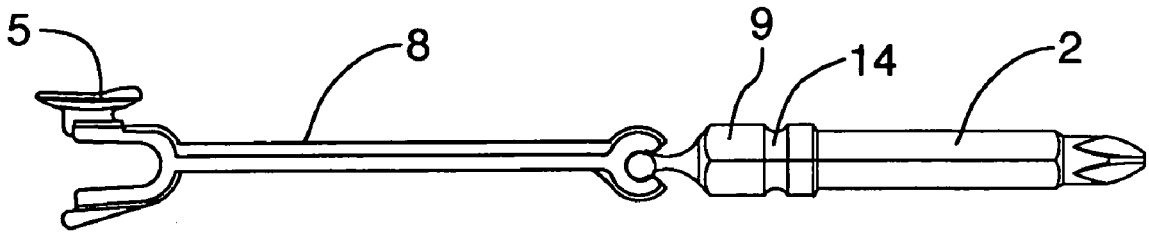
FIG.4 ( PRIOR ART )
FIG. 4 (prior art) is a side view of the bit actuation means for the hand tool of FIG. 1A.
Figure 5:
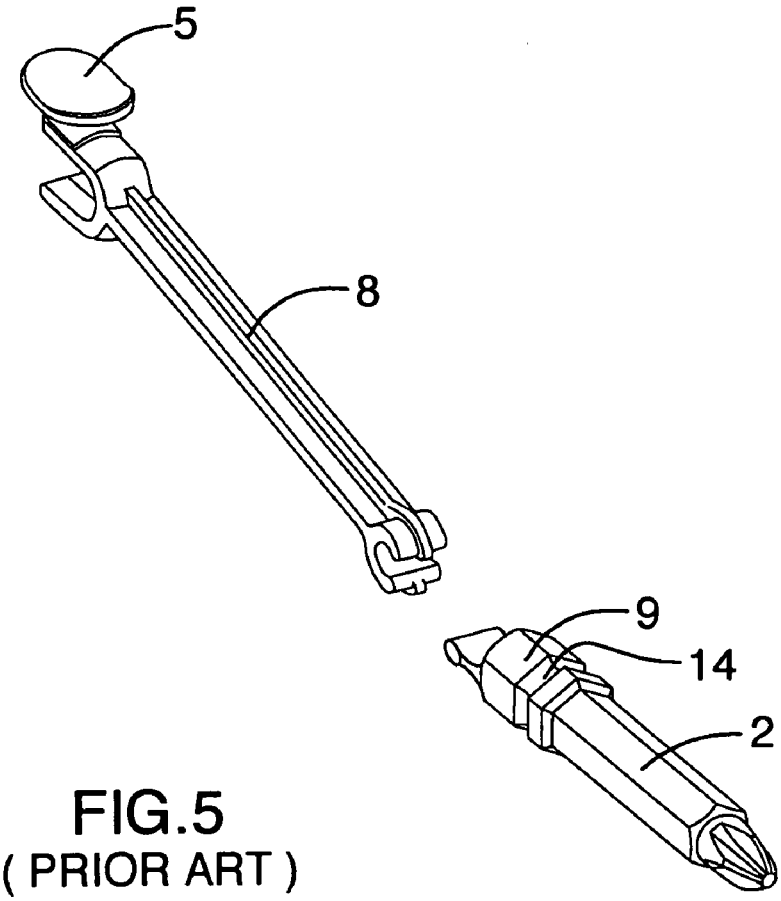
FIG.5 ( PRIOR ART )
FIG. 5 (prior art) is an exploded perspective view corresponding to FIG. 5A.
Figure 6A:
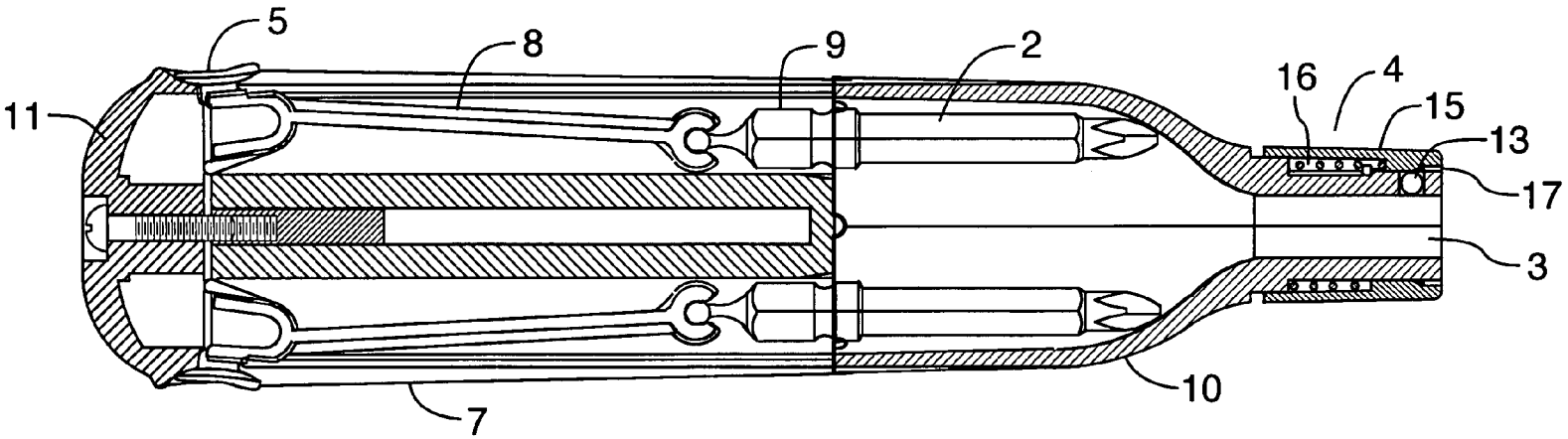
FIG.6A ( PRIOR ART )
FIG. 6A (prior art) is a side cross-sectional view of the hand tool of FIG. 1A, with all bits retracted.
Figure 6B:
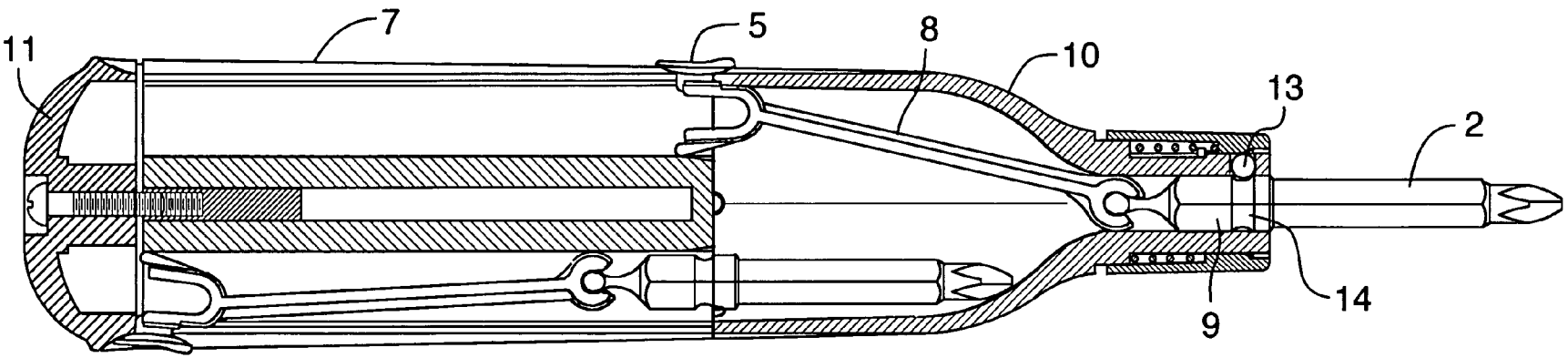
FIG.6B ( PRIOR ART )
FIG. 6B (prior art) is a side cross-sectional view corresponding to FIG. 6A, but with a bit extended.
Figure 7:
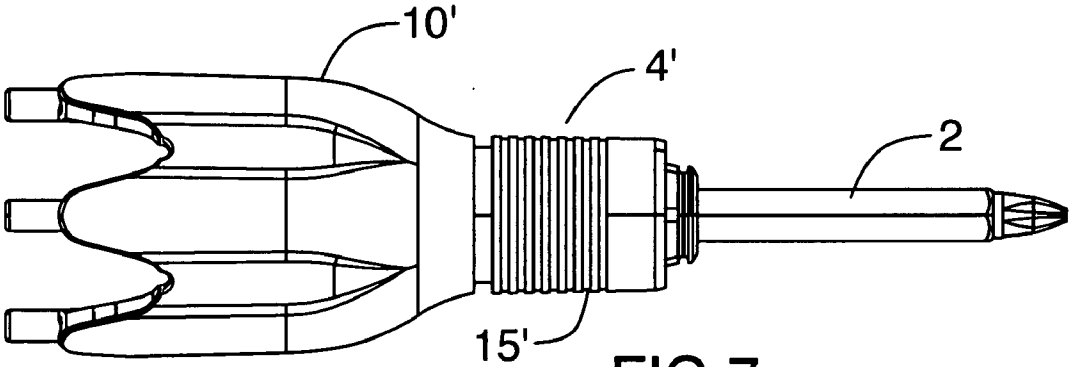
FIG. 7 is a side view of the preferred embodiment of the locking mechanism according to the invention.
Figure 8:
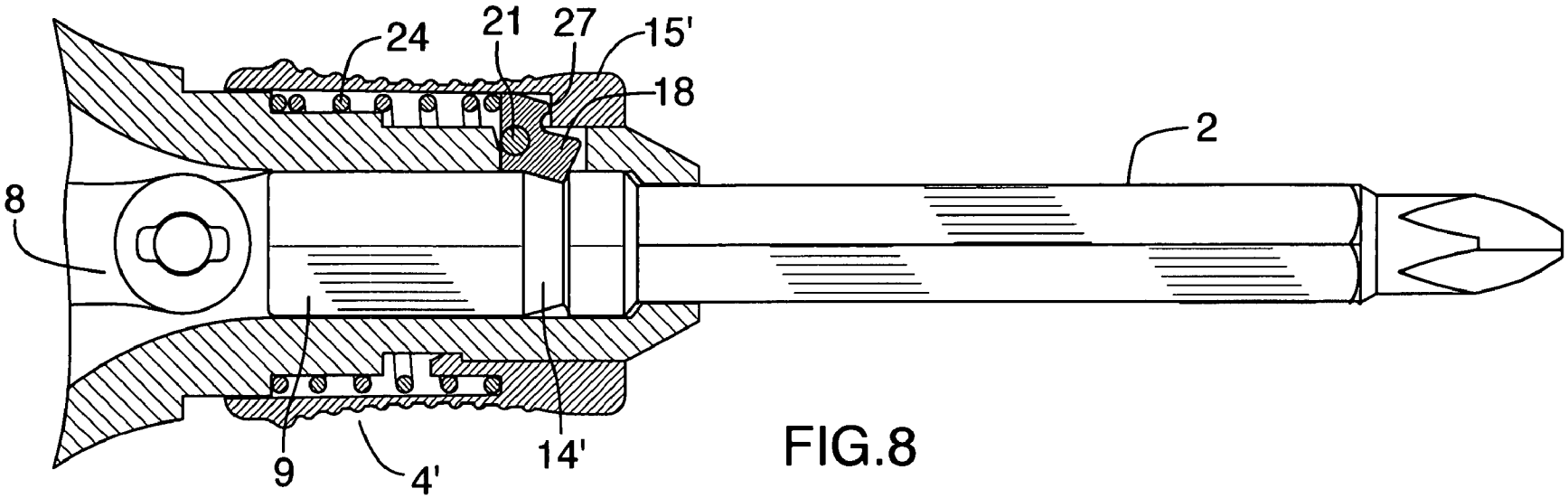
FIG. 8 is a corresponding cross-sectional view, showing a bit locked in its operative position.
Figure 9:
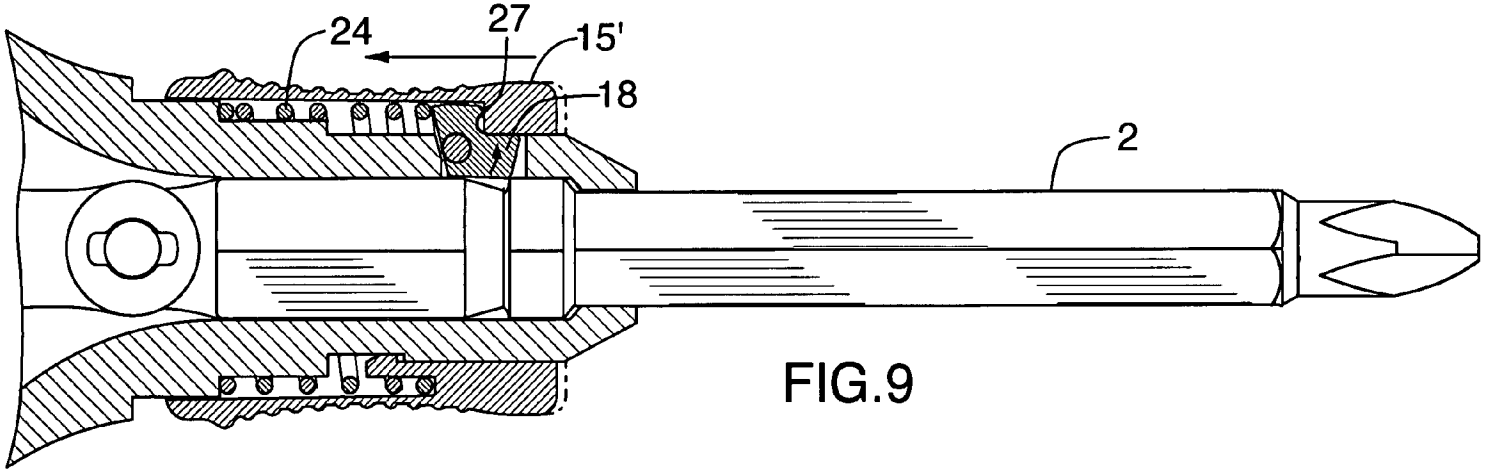
FIG. 9 is a view corresponding to FIG. 8, but showing the collar retracted to permit retraction of the bit.
Figure 10:
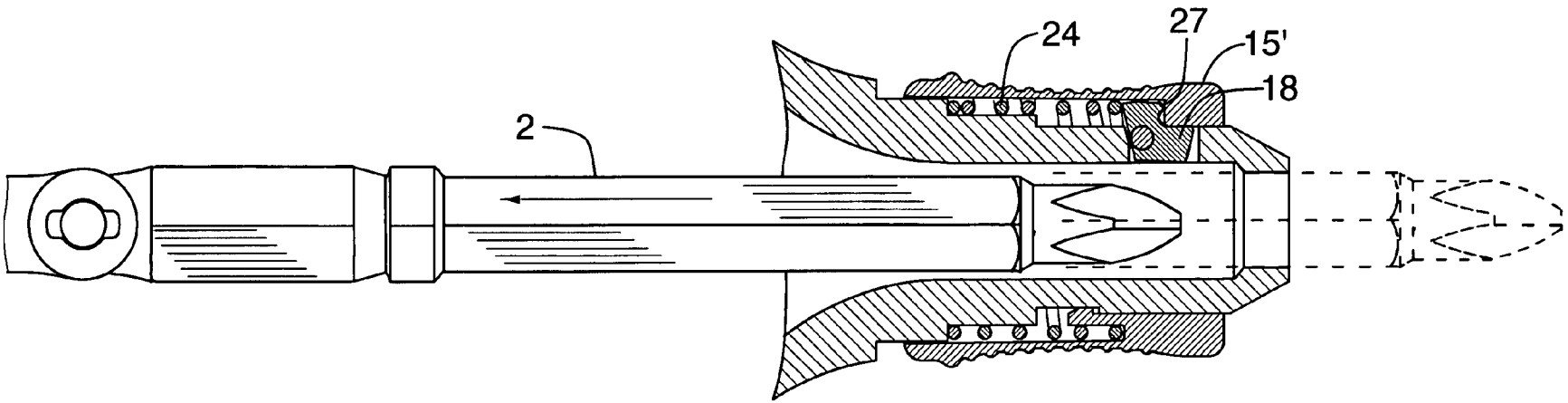
FIG. 10 is a view corresponding to FIGS. 8 and 9, showing the bit being retracted.

The invention will now be described in detail, with reference to the accompanying drawings.

FIGS. 1 to 6B show the multiple bit hand tool 1 of the inventor's U.S. Pat. No. 6,332,384. Bits 2 are extended and retracted through a central opening 3 in a chuck 4 by manipulation of buttons 5, which are slidable along slots 6 in the handle 7. As can be seen in FIGS. 3–6B, the buttons 5 are connected to integral actuation arms 8. The actuation arms are pivotally connected to bit holders 9, the bits 2 being mounted in the distal end of the bit holders. A front piece 10 channels the bits and bit holders towards the central axis of the chuck as the bits are extended. An end cap 11 is secured to the handle 7. The handle 7 is secured to the front piece 10 by screws 12.

In this prior art tool, the bit 2 was locked in its operative position by locking elements 13 engaging a notch 14 in the bit holder. It was necessary to manually retract a collar 15 in order to allow the locking elements to retract from the notch, either to extend the bit to its operative position, or to retract the bit to its storage position in the handle. As can be seen best in FIGS. 6A and 6B, a spring 16 biased the collar 15 to overlie the locking elements. When retracted, the collar provides a clearance area 17 sufficient to allow retraction of the locking elements. When released, the collar goes back to its home position, where retraction of the locking elements is blocked.

In the present invention, by contrast, locking of the bit or other tool element in its operative position as it reaches that position is fully automatic. The chuck 4' mounted on the front piece 10' has a mechanical element, such as a pivotal cam 18 in the preferred embodiment for example, which is biased towards a notch, lip or other engagement means on the tool element, such as a notch 14' on the bit or bit holder so that once the mechanical element engages the engagement means, the tool element cannot be retracted. A means for retracting the mechanical element is provided, for example a collar 15' which is configured to engage the mechanical element so that the user can retract the mechanical element to permit the bit or other tool element to be retracted.

In greater detail, as can be seen most clearly from FIGS. 8–11, when a bit 2 or other tool element is advanced into its operative position, it automatically locks into that position, by virtue of one or more (preferably three) cams 18. Each cam is movable into or out of engagement with the tool element, for example having a pivot point, for example pivot pins 21, preferably integral, which engage pivot grooves 22 in a main portion or base 23 of the chuck. The cams are biased by a spring 24, mounted around the base, between the base and the collar 15', so that they engage the notch 14' in the bit 2 or other tool element, preferably corresponding in shape to the shape of the cams. When so engaged, the cams prevent retraction of the bit or other tool element. When the user no longer needs that bit or other tool element and wants to retract it, he or she then retracts the collar 15'. The collar has an inner shoulder 27 which then contacts each cam, to rotate the cams so that they no longer engage the bit or other tool element, allowing it to be retracted. Other means could be employed for rotating or otherwise retracting the cams or other mechanical elements.

Figure 11:
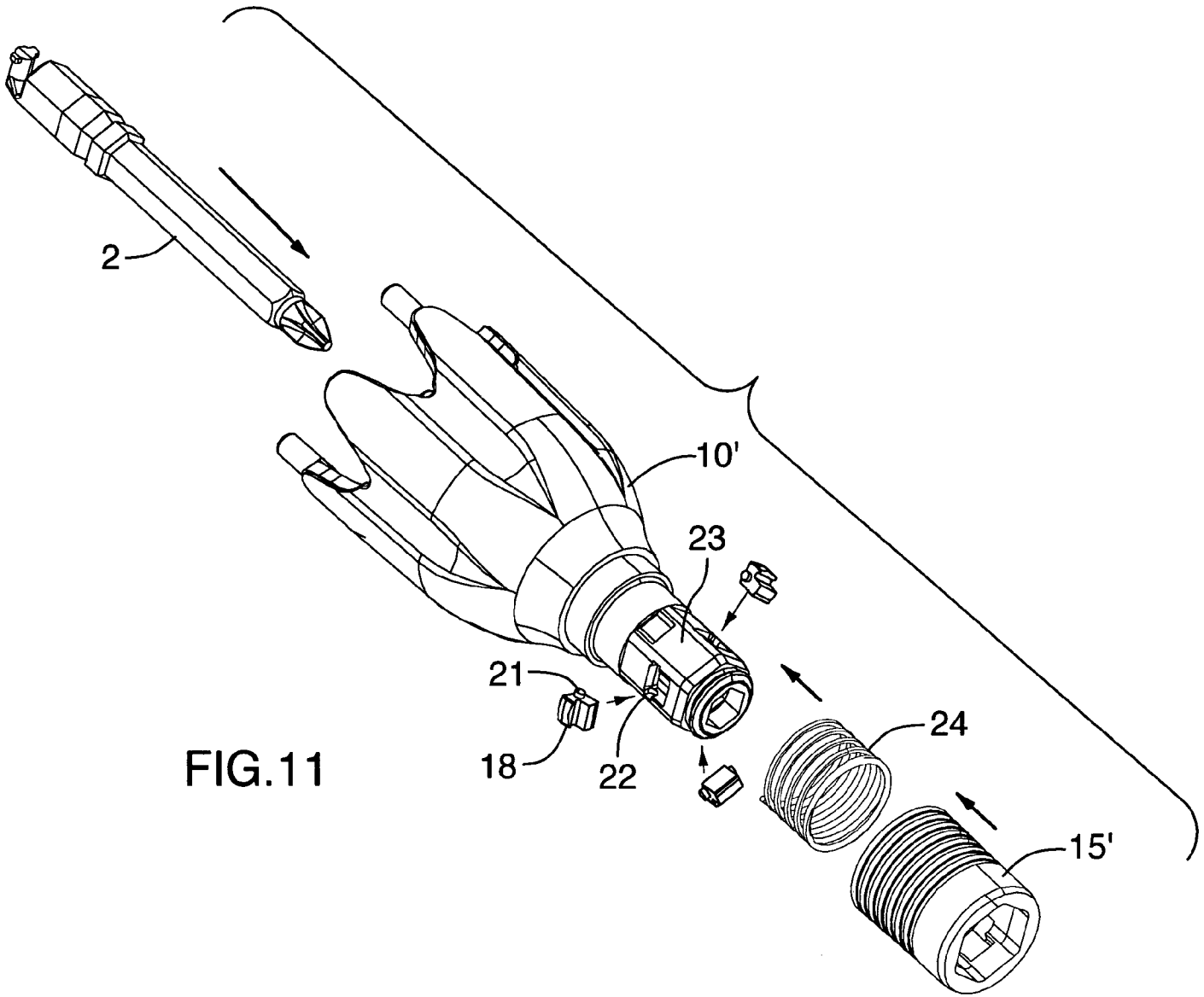
FIG. 11 is an exploded perspective view of the locking mechanism assembly.
Figure 12:
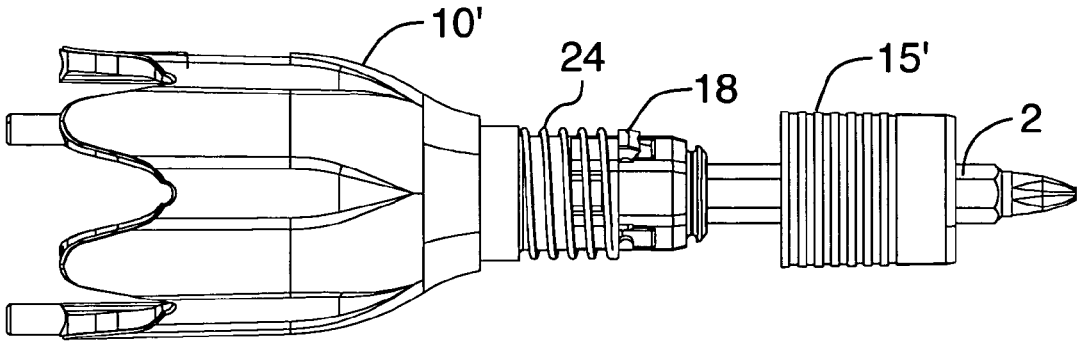
FIG. 12 is a side view with the collar removed.
Figure 13:
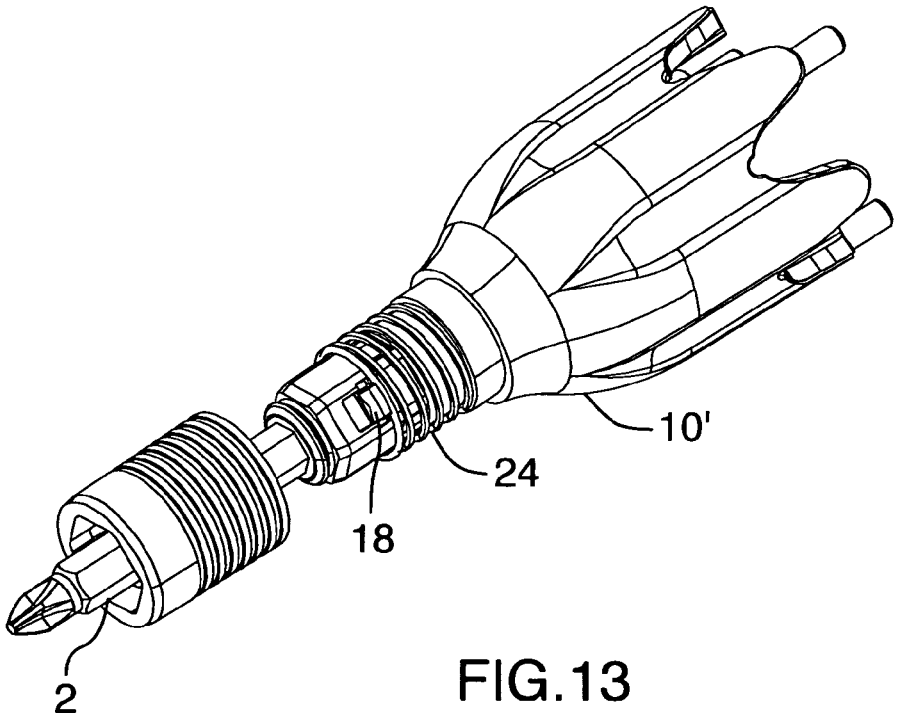
FIG. 13 is a perspective view with the collar removed.

As can be seen most clearly from FIGS. 11 and 12, there preferably are three cams 18 spaced circumferentially around the chuck. Of course, the invention could operate with just one or two cams, but three are considered preferable, for better force distribution and centering, for example. The bit holder preferably has the notch 14' extending continuously around it, for ease of manufacture and to avoid any possible alignment issues.

It will be appreciated that the above description relates to the preferred embodiments by way of example only. Many variations on the invention will be obvious to those knowledgeable in the field, and such obvious variations are within the scope of the invention as described and claimed, whether or not expressly described. For example, the size of the hand tool may be varied to suit different applications such as pocket screwdrivers or higher torque screwdrivers. Screwdriver bits may be replaced by a pen/pencil or scribing tip, or other non-screwdriver bits, which are retractable into the housing similar to the screwdriver bits described above. The most common application of the invention will be as a screwdriver, with the elements being screwdriver bits, but the invention is not limited to that.

In general, the invention may be applied to any hand tool of the same general type, i.e. any hand tool where a bit or other tool element is moved from a retracted position, through a central axial opening in a chuck to an extended operative position, as in the earlier invention, and in the present invention. Thus the present invention is not limited to any particular mechanism for storing tool elements and advancing them from their stored position; the focus of the invention is on automatically locking of the tool elements in their operative position once advanced.

The invention claimed is:

1. A hand tool having a chuck with a central axial opening where a tool element is movable from a retracted position in said hand tool where it is not in said chuck, through the opening to an extended operative position where at least a portion of said tool element extends from said chuck, said chuck comprising a locking means, configured such that said hand tool element is advanceable from its retracted position to its operative position without user manipulation of said chuck and such that as said tool element reaches its operative position, said locking means automatically engages said tool element and locks it in place in said chuck, such that said tool element then cannot be retracted without user intervention; said locking means comprising a mechanical element biased towards engagement means on said tool element, so that once the mechanical element is engaged with said tool element, said tool element cannot be retracted from its operative position, and further comprising means for retracting said mechanical element, operable by a user to permit said tool element to be retracted.

2. A hand tool as in claim 1, wherein said mechanical element comprises:

at least one cam pivotally mounted in said chuck, biased to engage said engagement means of said tool element, to prevent retraction of the tool element from its operative position; and means operable by a user to retract each said cam from engagement with said engagement means of said tool element, allowing the tool element to be retracted.

3. A hand tool as in claim 2, wherein said biasing of said at least one cam is by a spring.

4. A hand toot as recited in claim 2, wherein said means operable by a user to retract each said cam comprises a collar around said chuck, biased by a spring against retraction, arranged to contact said cam when retracted against the force of said spring, to rotate said cam so that it no longer engages said engagement means of said tool element, allowing the tool element to be retracted.

5. A hand tool as recited in claim 3, wherein said means operable by a user comprises a collar around said chuck, biased by a spring against retraction, arranged to contact said cam when retracted against the force of said spring, to rotate said cam so that it no longer engages said engagement means of said tool element, allowing the tool element to be retracted.

6. A hand tool as recited in claim 5, wherein the same spring biases both said cam(s) and said collar.

7. A hand tool as in claim 2, wherein there are three said cams spaced circumferentially around said chuck.

8. A hand tool as in claim 2, wherein said hand tool is a multiple-bit driver, and wherein at least one of said tool elements comprises a screwdriver bit.

9. A hand tool as in claim 3, wherein said hand tool is a multiple-bit driver, and wherein at least one of said tool elements comprises a screwdriver bit.

10. A hand tool as in claim 4, wherein said hand tool is a multiple-bit driver, and wherein at least one of said tool elements comprises a screwdriver bit.

11. A hand tool as in claim 5, wherein said hand tool is a multiple-bit driver, and wherein at least one of said tool elements comprises a screwdriver bit.

12. A hand tool as in claim 6, wherein said hand tool is a multiple-bit driver, and wherein at least one of said tool elements comprises a screwdriver bit.

13. A hand tool as in claim 7, wherein said hand tool is a multiple-bit driver, and wherein at least one of said tool elements comprises a screwdriver bit.

14. A hand tool as in claim 1, wherein said engagement means is a notch or lip provided in said tool element.

15. A hand tool as in claim 1, comprising:

an elongated housing having a plurality of longitudinal slots, each slot having a button slidable along said slot, connected to actuation arms within said housing, each actuation arm pivotally connected to a tool element holder, each tool element holder having a tool element extending from a distal end thereof, operation of a said button towards said chuck causing said tool element to extend through said central axial opening or retract therefrom.

16. A hand tool as in claim 2, comprising:

an elongated housing having a plurality of longitudinal slots, each slot having a button slidable along said slot, connected to actuation arms within said housing, each actuation arm pivotally connected to a tool element holder, each tool element holder having a tool element extending from a distal end thereot operation of a said button towards said chuck causing said tool element to extend through said central axial opening or retract therefrom.

17. A hand tool as in claim 4, comprising:

an elongated housing having a plurality of longitudinal slots, each slot having a button slidable along said slot, connected to actuation arms within said housing, each actuation arm pivotally connected to a tool element holder, each tool element holder having a tool element extending from a distal end thereof, operation of a said button towards said chuck causing said tool element to extend through said central axial opening or retract therefrom.

* * * * *

UNITED STATES PATENT AND TRADEMARK OFFICE

CERTIFICATE OF CORRECTION

PATENT NO. : 7,156,005 B2
APPLICATION NO. : 10/926965
DATED : January 2, 2007
INVENTOR(S) : Gary Paul Cluthe It is certified that error appears in the above-identified patent and that said Letters Patent is hereby corrected as shown below:

Column 4, line 44, delete “toot” and insert therefor --tool--; and

Column 6, line 7, delete “thereot” and insert therefor --thereof--.

Signed and Sealed this

Third Day of April, 2007

JON W. DUDAS
*Director of the United States Patent and Trademark Office*